United States Patent [19]

Knaak

[11] 4,035,141

[45] July 12, 1977

[54] SUPPORT RAIL FOR FURNACES

[75] Inventor: Rüdiger Knaak, Neuss, Germany

[73] Assignee: Koppers-Wistra-Ofenbau GmbH, Duesseldorf, Germany

[21] Appl. No.: 656,583

[22] Filed: Feb. 9, 1976

[30] Foreign Application Priority Data

Feb. 7, 1975 Germany ..... 2505130

[51] Int. Cl.[2] ..... F27D 3/02

[52] U.S. Cl. ..... 432/234; 432/122

[58] Field of Search ..... 432/234, 122, 127

[56] References Cited

U.S. PATENT DOCUMENTS

| | | | |
|---|---|---|---|
| 679,350 | 7/1901 | Williams | 432/234 |
| 3,304,070 | 2/1967 | Jones | 432/234 |
| 3,367,641 | 2/1968 | Molz | 432/234 |
| 3,544,094 | 12/1970 | Knaak | 432/234 |
| 3,642,261 | 2/1972 | Laws | 432/234 |
| 3,706,448 | 12/1972 | Salter et al. | 432/234 |

*Primary Examiner*—John J. Camby
*Attorney, Agent, or Firm*—Michael J. Striker

[57] ABSTRACT

In a furnace for heat treating of workpieces, a workpiece-engaging element which is adapted to support a workpiece which is to be advanced through and heat treated in the furnace is mounted upon a mounting surface of an elongated, internally-cooled supporting member. The supporting member includes a first section having first walls which diverge from each other in direction away from the mounting surface until the first walls define a maximum spacing therebetween. The supporting member also includes a second section adjoining the first section and having second walls which are spaced from each other at a predetermined distance not exceeding the maximum spacing so as to permit heat to flow towards the underside of the workpiece without being screened by the second walls.

15 Claims, 10 Drawing Figures

SUPPORT RAIL FOR FURNACES

BACKGROUND OF THE INVENTION

The present invention generally relates to metallurgical furnaces and, more particularly, to improvements in the design of elongated, internally-cooled supporting members commonly employed in walking beam and so-called pusher-type furnaces.

Metallurgical furnaces are employed for the continuous transport of ingots, slabs, rods, bars or like metallic workpieces through a heating chamber. The so-called pusher-type furnaces push the workpieces along the elongated rails and heat the workpieces on all sides thereof.

In such furnaces, contact between the workpieces and the rails along which they are pushed results in the formation of strip-shaped undercooled zones or darkened areas in the region of the workpiece surface which contacts the support. It will be appreciated that the rails must be cooled, usually by circulating cooling fluid through interior passages of the rails, so that they will not themselves be deformed at the elevated temperatures of the furnace. These undercooled zones are very undesirable because they adversely affect material characteristics, particularly during subsequent rolling.

In order to eliminate the formation of undercooled zones, so-called "riders" or workpiece-engaging elements constituted of heat-insulating material are mounted over the entire length of the rails. The workpieces are supported on these riders for the purpose of preventing undercooling of those portions of the workpieces which would otherwise be in direct contact with the internally-cooled rails.

However, the prior-art proposals have not proven altogether satisfactory in eliminating the formation of these undercooled zones. Basically, the temperature difference which causes this problem is derived from two sources. Firstly, there is the cooling effect of the fluid flowing through the supporting member which plays a major role during the time when the temperature of the workpieces is relatively constant. Secondly, there is the screening effect which hinders the flow of heat energy caused by the presence and location of the supporting member itself with respect to heat being directed towards the underside of the workpiece. The screening effect has its major impact during the time when the temperature of the workpieces is being increased.

It is known in the prior art to configurate the supporting member as narrow as possible in order to correspondingly reduce the screening effect. However, a very narrow supporting member has little mechanical rigidity and therefore tends to sag along its length. Vertically-arranged supports are generally arranged at selected intervals along the length of the supporting member to hold up the entire rail. If the supporting member sags, then a great number of such vertically-arranged supports will be needed which is especially undesirable since they not only consume heat due to their own internal cooling, but also screen the flow of heat energy towards the underside of the workpiece.

It has been further proposed to configurate the supporting member as a rectangle whose height is greater than its width so as to better withstand the tendency of the elongated supporting member to sag in a downward direction. However, because of the reduced width, the rectangularly-shaped supporting member tends to buckle transversely of its elongation, thereby still resulting in a mechanically unstable structure.

It is still further known to configurate the supporting member as an equilateral triangle, one of whose sides, or base, faces the lower portion of the furnace so that the base is horizontal to the furnace floor. The upwardly-directed apex of the triangularly-shaped supporting member is flattened so as to support a workpiece. Although this proposal is relatively much more mechanically stable as compared with the previously-mentioned prior-art proposals, this proposal is disadvantageous because the base is quite wide and therefore screens heat from reaching the underside of a workpiece. This proposal requires a very wide base in order to resist turning moments from bending and buckling the rail.

Thus, the current state of the art has two conflicting requirements. In order to make the structure sufficiently strong to resist bending, either a great number of vertically-arranged supports or a relatively massive supporting member is needed — both of which tend to screen heat. On the other hand, in order to uniformly warm all sides of a workpiece, it is desirable to reduce the cross-section of the rail which, of course, causes the rail to buckle and sag.

SUMMARY OF THE INVENTION

Accordingly, it is a general object of the present invention to overcome the disadvantages of the prior art.

Another object of the present invention is to substantially reduce the cross-section of the rail in order to reduce the screening effect without causing a loss in the mechanical rigidity of the rail.

Still another object of the present invention is to substantially prevent the formation of undercooled zones on the underside of a workpiece.

Yet a further object of the present invention is to provide a rail for transporting workpieces through furnaces which can accommodate high-loading conditions.

An additional object of the present invention is to provide a rail which does not require frequent spacing of vertically-arranged supports along its length.

Yet another object of the present invention is to improve the heat treatment of metallic workpieces.

In keeping with these objects and others which will become apparent hereinafter, one feature of the invention resides in, briefly stated, a combination in a furnace for heat-treating of workpieces which comprises a workpiece-engaging element adapted to support a workpiece which is to be advanced through and heat-treated in the furnace, and an elongated internally-cooled supporting member having a mounting surface which extends in direction of the elongation of the supporting member and upon which said element is mounted. The supporting member is comprised of a first section having first walls which diverge from each other in direction away from the mounting surface until the first walls define a maximum spacing therebetween, and a second section adjoining said first section which has second walls which are spaced from each other at a predetermined distance not exceeding the maximum spacing so as to permit heat to flow towards the underside of the workpiece without being screened by the second walls.

This configuration of the supporting member simultaneously satisfies both conflicting requirements noted above. The orientation of the first and second walls provides not only mechanical rigidity but also substantially reduces the quantity of heat being screened from the underside of a workpiece.

As compared with the rectangularly-shaped supporting member of the prior art, the strip-like uncooled zones are substantially reduced in size if not entirely eliminated. As for the equilateral triangular-shaped supporting member of the prior art, the cross-sectional width of the rail has been decreased which facilitates the heat treatment from below. Finally, with respect to a circularly-shaped supporting member, such rails are unnecessarily wide in order for them to adequately withstand the weight of the workpieces supported thereon so that these annular rails are also disadvantageous because they screen too much heat from the underside of a workpiece.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
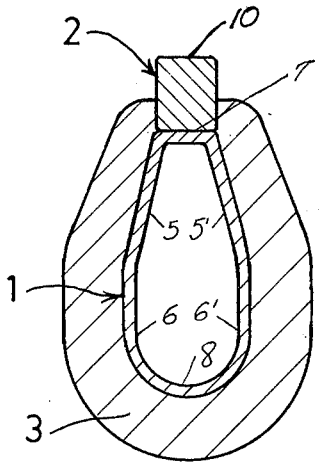
FIGS. 1–10 are cross-sectional views of respective embodiments in accordance with the present invention.

Referring jointly to all the FIGURES in the drawing, reference numeral 1 identifies an elongated, internally-cooled supporting member 1 which extends in direction into the plane of the respectively illustrated FIGURES. Reference numeral 2 identifies a workpiece-engaging element or rider 2 which is adapted to support a non-illustrated workpiece on its upwardly-directed planar surface 10 from below. Reference numeral 3 generally identifies heat-insulating means, generally constituted either of ceramic or metallic material, which is operative for insulating the bottom and opposite sides of the supporting member 1. The supporting member 1, the rider 2 and the heat-insulating means 3 together form a so-called supporting rail which is used to support a workpiece which is to be advanced through the heat-treated in a furnace or analogous heating chamber. As noted above, the invention is especially suitable for pusher-type or walking beam-type furnaces which are characterized in that they direct heat towards all sides of a workpiece, particularly a metallic workpiece.

In accordance with the invention, the supporting member 1 has a mounting surface 7 which has a length dimension which extends in direction of the elongation of the supporting member, i.e. into the plane of the drawing, and which also has a width dimension which extends in direction normally of the elongation of the supporting member, i.e. in a horizontal direction. The rider 2, which is preferably constituted of heat-resistant material, has a lower portion formed with a lower planar side which engages the mounting surface 7.

The supporting member 1 has a complex geometrical shape. It comprises a first section having first walls 5, 5' which diverge from each other in direction away from the mounting member surface 7 until the first walls 5, 5' define a maximum spacing therebetween. Another way of describing the first section is that it is fashioned after a trapezoid whose longer base has been removed. The supporting member 1 further comprises a second section which joins the first section and which has second walls 6, 6' which are spaced from each other at a predetermined distance which does not exceed the maximum spacing defined between the first walls 5, 5'. As will be shown below, this feature is important in permitting all sides of a workpiece to be uniformly heated.

Finally, the supporting member 1 also comprises a transverse wall 8 which is connected to and extends across said predetermined distance bounded by the second walls 6, 6' so as to close the interior of the supporting member through which a cooling medium is passed. The transverse wall 8 may be curved so that it resembles a semi-circular shape as in FIGS. 1, 2 and 4; alternatively, the transverse wall 8 may be linear, as in FIG. 3, so that it extends substantially normally to the elongation of the supporting member 1 and meets the second walls 6, 6' at generally right-angled corners which are preferably rounded.

Figure 5:
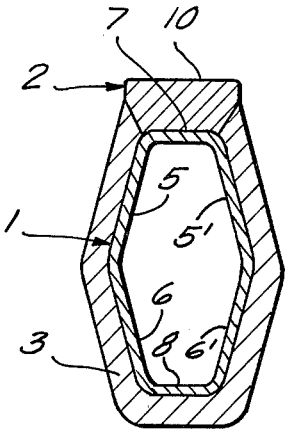
Figure 6:
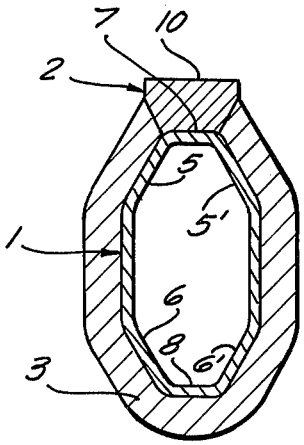

As noted above, since the second walls 6, 6' are to be spaced at a predetermined distance from each other, the second walls 6, 6' may be located either substantially parallel to each other, or they may converge towards each other in direction away from the mounting surface 7 until they meet a linear transverse wall similar to the one identified by reference numeral 8. In this latter case, as shown in FIG. 5, the second section resembles an inverted trapezoid whose longer base is removed and whose shorter base faces away from the first section. It is also advantageous in this double-trapezoidal configuration to situate mutually parallel partitions which lie in vertical planes between the first upper and second lower trapezoidal sections, as shown in FIG. 6.

Figure 3:
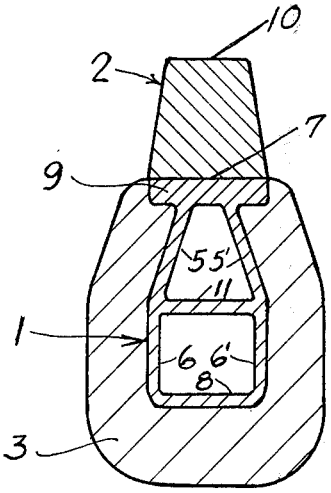

A linear horizontally-extending partition 11, as shown in FIG. 3, is located intermediate the first and second sections so as to further strengthen the mechanical rigidity of the supporting member.

Figure 2:
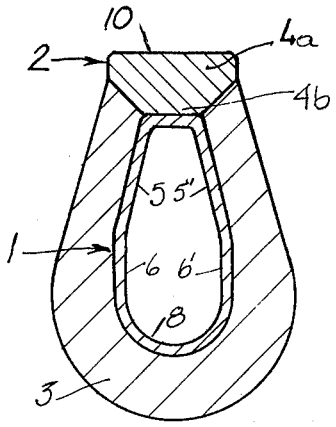

Also, the mounting surface 7 is differently configurated depending upon the application. For example, the riders 2 of FIGS. 1 and 4 have an upper portion formed with an upwardly-directed planar surface 10 and a lower portion mounted on the supporting member which has the same cross-section as the upper portion. In FIG. 2, the upper portion **4*a* has a wider cross-section as compared with lower portion 4*b* which is particularly desirable in supporting relatively heavy workpieces. In FIG. 3, the lower portion has a broader cross-section than its upper portion so that extension portions 9 which extend in horizontal direction normally of the elongation of the supporting member are provided so as to form a broader engagement surface for the rider 2**.

Figure 7:
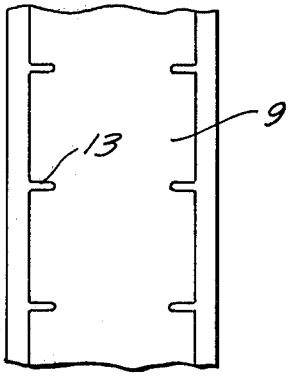
Figure 8:
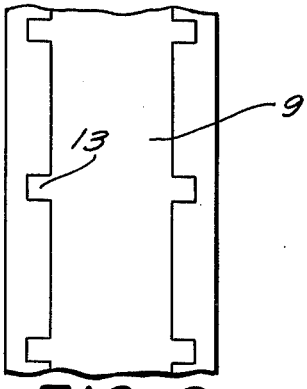

In order to prevent excessive stresses caused by heat, the extension portions 9 are further formed with breaks or openings 13 arranged in the direction of the elongation of the supporting member. These breaks may extend continuously along the entire length of the supporting member; or, these breaks may be provided only at selected intervals along the length of the supporting member, as shown in FIGS. 7 and 8.

The first section extends in direction away from the mounting surface 7 for a certain predetermined height as measured in the vertical direction. The second section extends in the same direction further away from the mounting surface 7 until the second section has a height which is at least approximately one-half of the aforementioned predetermined height.

The heat-insulating means 3 also contributes to the mechanical rigidity of the rail and generally has a thickness of at least 50 millimeters.

The configuration of the rail has the following advantages during the operation of the furnace: Since the upper portion of the rail is upwardly tapered towards the underside of the workpiece, the area of contact between the underside of the workpiece and the rider is minimized, thus permitting a major portion of the heat to treat the underside and substantially reducing the size and formation of any strip-shaped undercooled zones. Since the lower portion of the rail does not exceed the aforementioned maximum spacing defined by the first walls, no screening effect is caused by the second walls. Thus, the heat flow coming from directly below the rail towards the underside of the workpiece is not substantially impeded.

The rail manufactured in accordance with the present invention not only satisfies the requirement for not impeding the heat flow, but also satisfies the requirement for mechanical strength. The number of vertical supports below the rail need not be spaced at frequent intervals since the rail itself is resistant to sagging.

Figure 4:
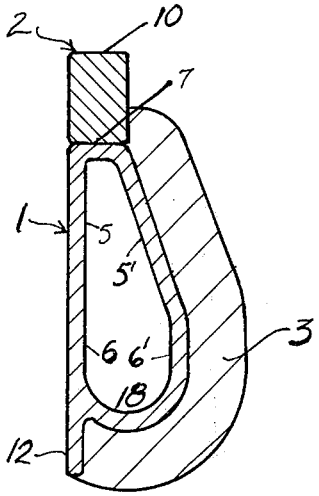

In FIG. 4, a further embodiment of the invention is illustrated which is particularly useful in walking-beam-type furnaces. The details of such a furnace are well known to those skilled in the art, and it is therefore believed that a detailed discussion of the parts of such a furnace are unnecessary. For the sake of completeness of disclosure, the contents of West German Pat. No. 1,533,978 can be referred to and the contents of U.S. Pat. No. 3,544,094 are herewith incorporated by reference.

Figure 9:
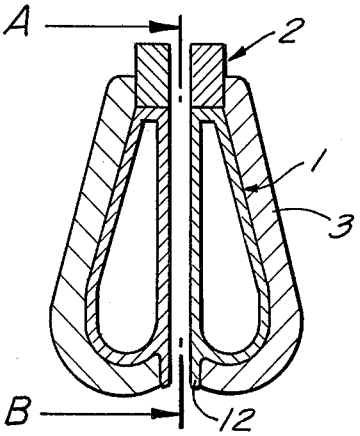

A walking-beam furnace generally comprises a stationary beam and a movable walking beam adjoining the stationary beam, as shown in FIG. 9. Each beam is internally-cooled and has its outer side insulated from heat and its inner side facing the other respective inner side so as to bound a narrow vertical gap.

Figure 10:
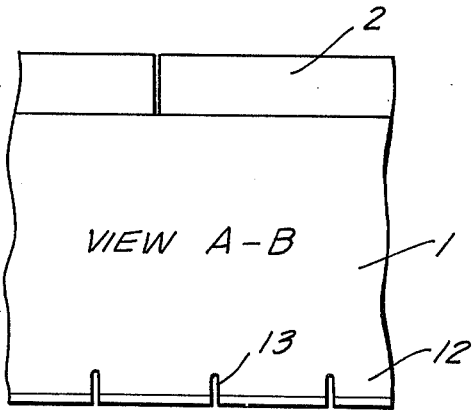

One of these beams is illustrated in FIG. 4, wherein the right outer side of the rail 1 is insulated and the left inner side of the rail is uninsulated. In this embodiment, first wall 5 and second wall 6 are colinear and lie on a common vertical line. It will be understood that another beam is situated adjacent the left side of the illustrated beam. Also, a projecting wall 12 extends along this common line and may include vertical slits or breaks 13 spaced from each other, as shown in FIG. 10.

It will be understood that each of the elements described above, or two or more together, may also find a useful application in other types of constructions differing from the types described above.

While the invention has been illustrated and described as embodied in a support rail for furnaces, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent are set forth in the appended claims:

1. In a furnace for heat-treating workpieces, a workpiece support arrangement designed to minimally interfer with the flow of furnace heat in upward direction towards the undersides of the workpieces being supported, the support arrangement comprising, in combination, a workpiece-engaging element adapted to support a workpiece which is to be advanced through and heat-treated in the furnace; and an elongated, internally cooled supporting member comprised of an upper first section including a generally horizontal top wall having a mounting surface which extends in the direction of the elongation of said supporting member and upon which said element is mounted, said first section also including first side walls, said generally horizontal top wall forming a bridge from which said first side walls downwardly diverge in straight lines to define at the bottom of said first section a maximum breadth, said supporting member also having a lower second section including respective second side walls spaced from each other a distance not exceeding said maximum breadth, whereby furnace heat flowing upwardly toward the underside of a supported workpiece along the side walls of the lower section can flow without hindrance from the side walls of the lower section up to and along the side walls of the upper section.

2. A combination as defined in claim 1, wherein said mounting surface is planar, and wherein said element has a lower portion formed with a lower planar side which is in surface engagement with said mounting surface.

3. A combination as defined in claim 1, wherein said second walls extend in direction further away from said mounting surface until said second walls have a height which is at least one-half of said predetermined height.

4. A combination as defined in claim 1, wherein said element has an upper portion having an upwardly-directed surface adapted to support a workpiece from below and a lower portion mounted on said mounting surface of said supporting member, said upper portion having a larger cross-section than said lower portion.

5. A combination as defined in claim 1, wherein said second section further comprises a linear transverse wall connected to and extending across said second walls in direction substantially normal to the elongation of said supporting member, said linear transverse wall meeting said second wall at generally right-angled corners which are rounded.

6. A combination as defined in claim 1, wherein said second section further comprises a curved transverse wall connected to and extending across said second wall, said curved transverse wall being configured as a semi-circularly-shaped outline.

7. A combination as defined in claim 1, wherein said second walls are substantially parallel to each other.

8. A combination as defined in claim 1, wherein said second walls converge towards each other in direction away from said mounting surface, said second section further comprising a linear transverse wall connected to and extending across said second wall in direction substantially normal to the elongation of said supporting member.

9. A combination as defined in claim 8, wherein said mounting surface has a width dimension extending in direction normally of the elongation of said supporting member; and further comprising a plurality of mutually parallel partitions spaced in direction across said width dimension of said mounting surface in planes normal thereto.

10. A combination as defined in claim 1; and further comprising a linear partition extending in direction transversely of the elongation of said supporting member intermediate said first and second sections.

11. A combination as defined in claim 1, wherein said mounting surface comprises extension portions which extend in direction normally of the elongation of said supporting member so as to form a wider surface area.

12. A combination as defined in claim 11, wherein said extension portions are formed with openings extending in direction entirely along the elongation of said supporting member.

13. A combination as defined in claim 11, wherein said extension portions are formed with openings which extend in direction along the elongation of the supporting member at selected intervals thereof.

14. A combination as defined in claim 1, wherein said mounting surface has a width dimension extending in direction normally of the elongation of said supporting member, and wherein one of said first walls and one of said second walls are colinear and lie on a common line which extends in direction normally of the width dimension of said mounting surface.

15. A combination as defined in claim 14; and further comprising a projecting wall extending in direction colinearly with said common line on which said one first wall and said one second wall are situated.

* * * * *